United States Patent [19]

Altherr et al.

[11] 4,090,614

[45] May 23, 1978

[54] ROTARY TYPE RAILWAY CAR COUPLER

[75] Inventors: Russell George Altherr, Munster, Ind.; John Walter Kaim, Chicago, Ill.

[73] Assignee: Amsted Industries Incorporated, Chicago, Ill.

[21] Appl. No.: 729,050

[22] Filed: Oct. 4, 1976

[51] Int. Cl.[2] ..... B61G 1/00

[52] U.S. Cl. ..... 213/62 A; 213/67 R; 213/75 R

[58] Field of Search ..... 213/62 R, 62 A, 63, 213/64, 67 R, 67 A, 69, 72, 75 R; 403/13, 14, 383; 280/491 A, 491 E, 482

[56] References Cited

U.S. PATENT DOCUMENTS

| | | | |
|---|---|---|---|
| 1,701,571 | 2/1929 | Knill | 403/13 |
| 1,766,609 | 6/1930 | Dath | 213/67 A |
| 2,425,838 | 8/1947 | Shultz | 280/491 A |
| 3,157,290 | 11/1964 | Kulieke | 213/62 A |
| 3,406,988 | 10/1968 | Jones | 403/14 |
| 3,610,436 | 10/1971 | Wisley | 213/62 A |

FOREIGN PATENT DOCUMENTS

| | | | |
|---|---|---|---|
| 947,675 | 8/1956 | Germany | 280/491 A |

*Primary Examiner*—Galen L. Barefoot
*Attorney, Agent, or Firm*—Fred P. Kostka

[57] ABSTRACT

A rotary type railway car coupler is provided wherein the shank and yoke collar can be assembled only in the proper orientation with respect to one another. Either the shank or yoke collar is provided with a projection and the other is provided with a corresponding groove.

1 Claim, 3 Drawing Figures

ROTARY TYPE RAILWAY CAR COUPLER

BACKGROUND AND SUMMARY OF THE INVENTION

The present invention relates to a means for ensuring the proper assembly of a rotary type railway car coupler and more particularly to a specific structure which will not permit the yoke collar to be assembled 180° out of phase with the proper orientation.

The railway car coupler of the present invention is generally applied to railway cars used for rotary dump service where the rotating car remains coupled to the immediately adjacent cars. The coupler is mounted on a railway car which is designed to be unloaded by individually clamping the car body in a device which rotates the entire car including trucks about a longitudinal axis near the normal axis of the couplers until the car is unloaded, and then rotates the empty car back to its normal position. During this operation the adjacent cars remain stationary in a normal upright position.

The cars provided for this application are generally equipped with a rotary type coupler at one end and a standard stationary coupler at the other end. The train is then assembled so that each rotary type coupler is coupled to a standard stationary coupler. Each rotary coupler must therefore be capable of rotating with respect to the car on which it is mounted.

The rotary type coupler includes a shank which is attached to the car by being pinned to a yoke collar associated with a draft gear. The yoke collar bears against a yoke during a draft condition. The butt end of the shank bears against a follower located in the center sill during a buff condition. Therefore, when the car is rotated for unloading, the coupler and its shank, the connecting pin and yoke collar all remain stationary while the yoke, follower, and draft gear all rotate with the car.

In the normal running position of the coupler, the connecting pin is held in a vertical position. The yoke collar has an opening which receives the pin and that opening is restricted at its opposite end by a pin seat flange. When the coupler is properly assembled, the pin seat flange is at the bottom of the yoke collar, and therefore, the pin is held oriented in its correct position. In this proper position the collar is designed to assume the stresses imposed thereon by the pin during a draft condition.

In order to assemble this coupler, however, the yoke collar must be inserted in the yoke with the pin seat flange up. Then the coupler shank is inserted, also inverted with respect to the car, through the end of the yoke and into the yoke collar until the hole in the shank aligns with the opening in the yoke collar. The connecting pin is then inserted from the bottom, and the coupler, connecting pin and yoke collar are rotated 180° so that the coupler is in its running position and the pin is resting on the pin seat flange which is now properly at the bottom of the yoke collar.

Occasionally, however, after the yoke collar has been properly inserted in the yoke with the pin seat flange up which is necessary to accept the pin from below, the coupler shank is incorrectly inserted in its normal running position. The pin is then inserted from below, and a cover plate is fixed in place. Under these conditions, the coupler, of course, is not rotated because it is already in its proper position.

When the coupler has been assembled as above, the pin seat flange is at the top of the yoke collar, and the pin is free to fall from its proper position through the opening in the bottom of the yoke and rest against the cover plate.

This improper positioning of the connecting pin greatly reduces, and occasionally completely eliminates, the bearing area of the pin on the upper portion of the yoke collar. Thus during running operation, the entire draft load is concentrated at the bottom of the yoke collar, often resulting in fracture of the yoke collar and severe damage to the coupler shank. Furthermore, this improper positioning of the connecting pin would seriously affect the operation of the connection when the car is rotated for unloading.

It is a primary object of the present invention to provide a rotary type railway car coupler constructed and arranged to overcome the difficulties encountered heretofore and thereby improve the service life and reliable operation thereof.

According to the present invention this is accomplished by providing a means for ensuring that the shank and yoke collar are assembled in the proper orientation with respect to one another. In one embodiment of the invention, a projection is provided on the inside of the yoke collar and a corresponding groove is formed in the coupler shank so that the shank and yoke collar must be assembled with the pin seat flange located at the bottom of the yoke collar when the coupler is in its running position. This structure precludes the misapplication of the coupler shank by rejecting the shank if it is not properly oriented with respect to the yoke collar and assures that the coupler will always be assembled so that the pin seat flange is at the bottom of the yoke collar.

DESCRIPTION OF THE PREFERRED EMBODIMENT

Figure 1:
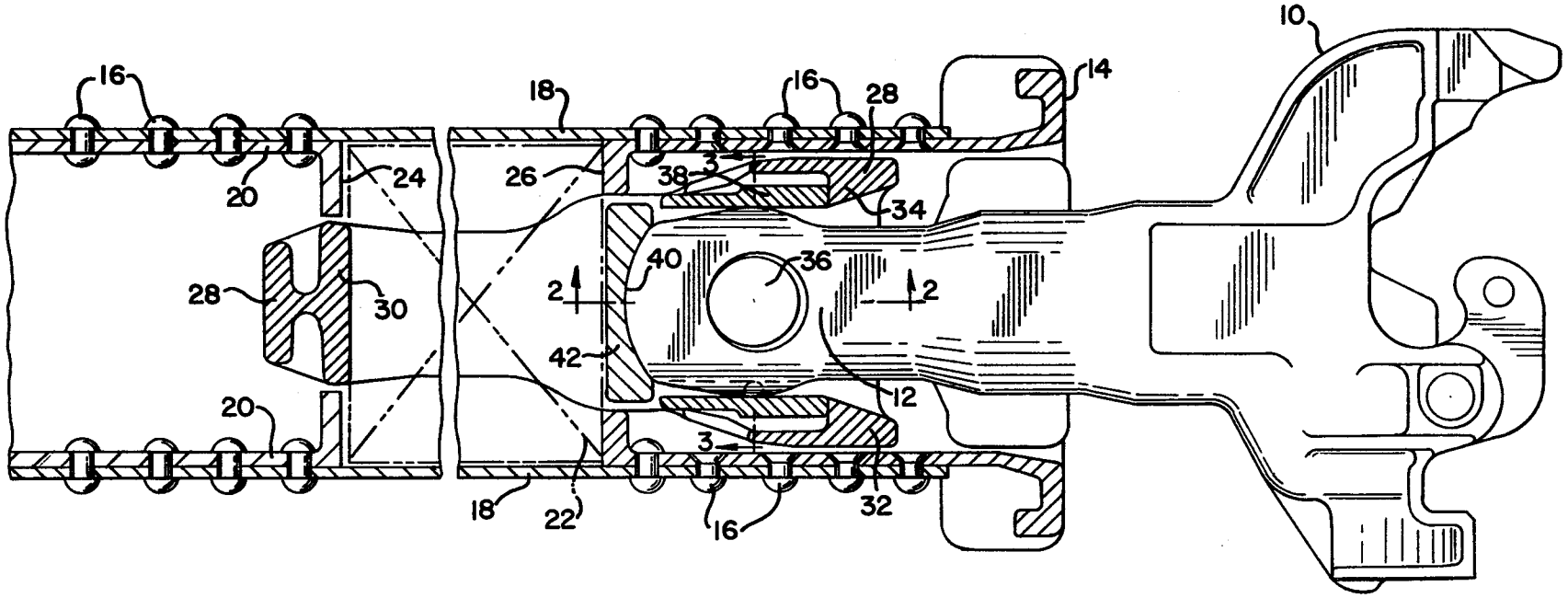
FIG. 1 is a top plan view, partly in section, of a rotary type railway car coupler embodying the present invention.

Referring now to the drawings, in FIG. 1 there is shown a coupler 10 having a shank 12 which is inserted into the open end of striker 14 having front stops 26. Striker 14 is attached by any suitable means such as rivets 16 to the center sill 18. Also suitably attached as by rivets 16 to sill 18 are rear lugs 20 having rear stops 24. A draft gear 22 is diagrammatically represented in phantom lines as being interposed between stops 24 and stops 26.

A yoke 28 extends from a rear portion 30 behind draft gear 22 to a front portion 32 having a radially inward extending flange 34. The shank 12 of coupler 10 is pinned by connecting pin 36 to a yoke collar 38. The leading edge of yoke collar 38 is arranged to abut the trailing edge of flange 34 of yoke 28.

In a draft condition of the coupler 10, shank 12, acting through connecting pin 36, urges yoke collar 38 forward (to the right in FIG. 1). Yoke collar 38 abuts flange 34 and moves yoke 28 forward. Rear portion 30 of yoke 28 contacts the rear end of draft gear 22 thereby urging the front end of draft gear 22 into contact with stops 26. Striker 14 transmits the draft forces directly to the railway car body sill 18.

In a buff condition of coupler 10, the butt end 40 of shank 12 pushes follower 42 into contact with the front end of draft gear 22. The rear end of draft gear 22 bears against rear stops 24 thereby permitting rear lugs 20 to transmit the buff load to the sill 18.

Figure 2:
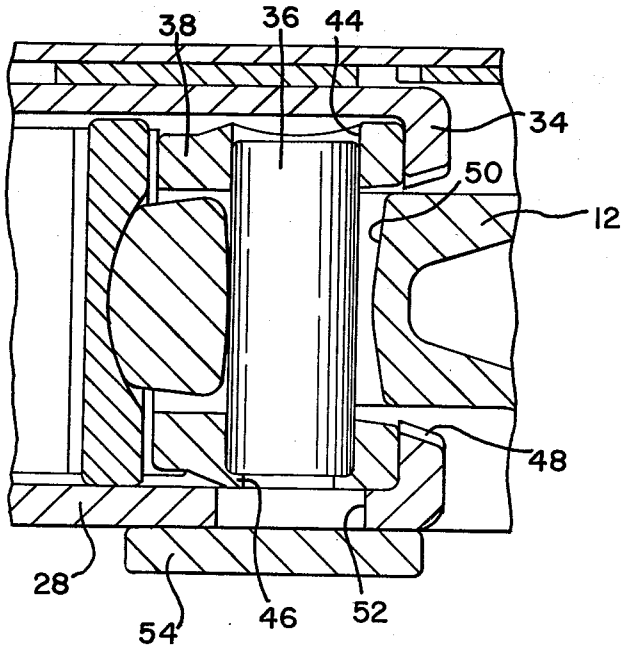
FIG. 2 is an enlarged cross sectional view taken generally along line 2—2 of FIG. 1.

As shown in FIG. 2, the yoke collar 38 has an opening 44 therein for receiving connecting pin 36. Opening 44 is open at one end so that pin 36 can be inserted, but restricted at the other end by pin seat flange 46. The assembly of FIG. 2 is shown in its normal running position with pin 36 being held in its proper position by pin seat flange 46.

Figure 3:
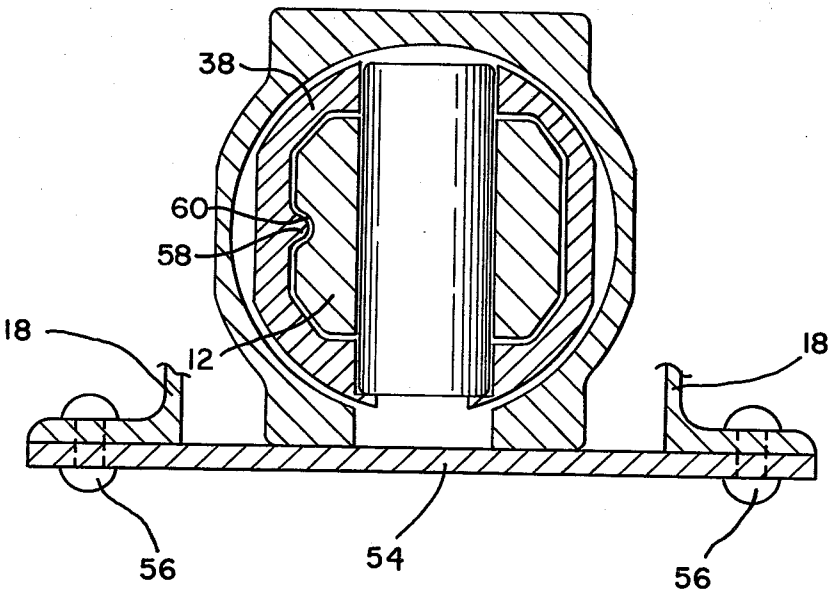
FIG. 3 is a cross sectional view taken generally along line 3—3 of FIG. 1.

In order to assemble the coupler, however, yoke collar 38 must be inserted into yoke 28 in an inverted position relative to that assumed in the normal operating position. That is, yoke collar 38 must be inserted with the open end of opening 44 at the bottom and pin seat flange 46 adjacent the top of the coupler housing or striker assembly. Shank 12 is then inserted, also in an inverted position, through opening 48 formed by flange 34 in the end of yoke 28. When the hole 50 in shank 12 is aligned with opening 44 and access hole 52 in the bottom of yoke 28, pin 36 is inserted from the bottom through access hole 52 to connect yoke collar 38 with shank 12. Shank 12, pin 36 and yoke collar 38 are then rotated 180° so that they assume the position shown in the drawings. Pin 36 is held in its proper position by pin seat flange 46. Yoke support plate 54 is fixed in place to the center sill 18 by any suitable means such as rivets 56 (FIG. 3).

In order to overcome the difficulties outlined in the background information above, the coupler of the present invention is provided with a means for ensuring that the coupler must be assembled so that when the coupler is in its proper normal running position, pin seat flange 46 is at the bottom of yoke collar 38. One embodiment of this means is illustrated in FIG. 3.

A projection 58 is provided on one of the inside faces of yoke collar 38, and a corresponding groove 60 is formed in the outside of shank 12. The projection 58 and groove 60 are located so as to seat only when shank 12 is inserted into yoke collar 38 with the bottom side of shank 12 adjacent pin seat flange 46. The projection 58 is preferably of the hemispherical type as can be seen in FIG. 1 rather than being an elongated key. This allows for the required freedom of horizontal and vertical movement of coupler 10.

Thus, with the presence of projection 58 and groove 60, the shank and yoke collar cannot be assembled improperly. If an attempt is made to insert shank 12 in an upright position into an inverted yoke collar of the present invention, the projection 58 will be on the opposite side of shank 12 from its groove 60. Projection 58 will interfere with shank 12 and therefore reject the attempted misapplication.

Naturally, the same advantages could be achieved by providing a projection on the outside of shank 12 and a corresponding groove in the inside of yoke collar 38. Also, more than one set of projections and grooves can be used so long as the shank 12 will be rejected if not inserted into the yoke collar 38 in its proper orientation with respect thereto.

I claim:

1. Rotary type railway vehicle coupler arrangement comprising a yoke having a cylindrical bore, a yoke collar rotatably seated in said cylindrical bore, said yoke collar having a diametrically extending pin hole extending through said bore and having a pin seat flange adjacent one end thereof, a coupler comprising a coupler shank received in said yoke collar and having an opening axially alignable with said pin hole, said coupler including a coupling head having a top side and a bottom side, a substantially semi-hemispherical projection formed on said yoke collar and a groove of substantially semi-circular cross section formed in said coupler shank for receiving said substantially semi-hemispherical projection and located such that said coupler head bottom side is on the same side as said pin seat flange, and pin means extending through said aligned pin hole and shank opening for connecting said coupler shank for rotation with said yoke collar, said projection being located so as to permit freedom of horizontal and vertical movement of the coupler shank.

* * * * *